US005157369A

United States Patent [19]

Yao

[11] Patent Number: 5,157,369

[45] Date of Patent: Oct. 20, 1992

[54] CIRCUIT BREAKER SWITCH

[75] Inventor: Kelvin Yao, Edison, N.J.

[73] Assignee: Rototech Electrical Components, Inc., Edison, N.J.

[21] Appl. No.: 788,983

[22] Filed: Nov. 7, 1991

[51] Int. Cl.[5] ..... H01H 71/16

[52] U.S. Cl. ..... 337/68; 337/62

[58] Field of Search ..... 337/68, 91, 62, 64, 337/66, 74, 72, 56

[56] References Cited

U.S. PATENT DOCUMENTS 5,001,450 3/1991 Wu ..... 337/68

*Primary Examiner*—Harold Broome

*Attorney, Agent, or Firm*—Omri M. Behr

[57] ABSTRACT

A thermally and manually operable circuit breaker switch has a housing and first and second conductive plates mounted in the housing. This first plate has a first contact. A cantilevered bimetallic blade is mounted on the second plate and has a free end and a second contact. This second contact is mounted on the free end opposite the first contact. The switch also has a push button with a lateral isolating tab slidably mounted together in the housing. A spring is mounted in the housing for outwardly urging the push button and causing the tab to keep apart the first and second contacts. Also, included is a push rod slidably mounted in the housing transverse to the length of the bimetallic blade and aligned with its free end. Thus, depression of the push rod flexes the blade and separates the first and second contacts to allow the tab to keep the contacts apart.

10 Claims, 3 Drawing Sheets

CIRCUIT BREAKER SWITCH

BACKGROUND OF THE INVENTION

The present invention relates to an automatic circuit breaker switch, which utilizes a bimetallic blade, a push button to make a circuit and a push rod to break a circuit.

Known circuit breakers have employed a bimetallic contact that flexes when excessive current flows through it. This flexing can release a spring loaded push button to separate contacts and open a circuit. Such arrangements are noted for its simplicity and reliability. To add flexibility, known circuit breakers have included a separate manual push rod or lever to open the contacts manually.

In U.S. Pat. No. 5,001,450, a circuit breaker has a push button with a lateral tab. The tab can be spring biased against the side of a pair of electrical contacts. One of the contacts is supported by a bimetallic blade, which lifts the contact when excessive current flows. When the contacts thus separate, the lateral tab of the push button is driven by its spring to a position between the contacts, keeping them open even when the bimetallic element cools. An alternate way of opening the contacts is provided by a push rod having a bevelled inside end. The bevel can engage the underside of an extended portion of the bimetallic blade. One disadvantage with this known circuit breaker is the need to extend the bimetallic blade simply to accommodate the push rod that can manually break this circuit. Additionally, the bevelled end of the push rod not only applies a force that lifts and separates the contacts, but also a force transverse to the contacts that tends to twist and misalign the bimetallic blade and the contacts. Also with the higher forces necessary to operate a bevelled push rod, there is a greater tendency for wear and jamming.

Other known bimetallic circuit breakers employ manual devices to open the circuit, but these have disadvantages as well. These known manual devices either operate indirectly and require additional material or mechanisms; or operate at an inefficient angle which increases the force necessary to break a circuit. For switches having circuit-making push buttons that are parallel to circuit breaking push rods, see: U.S. Pat. Nos. 1,784,207; 1,928,940; 2,767,281; 2,768,262; 2,824,932; and 2,952,757. Other bimetallic switches are shown in U.S. Pat. Nos. 3,211,862; 4,044,325; 4,570,142; and 4,573,031.

Accordingly, there is a need for a bimetallic circuit breaker having a push button to make and a push rod to break a circuit, which are arranged to operate efficiently and without excessive forces and friction.

SUMMARY OF THE INVENTION

In accordance with the illustrative embodiments demonstrating features and advantages of the present invention, there is provided a thermally and manually operable circuit breaker switch having a housing and first and second conductive plates mounted in the housing. The first plate has a first contact. A cantilevered bimetallic blade is mounted on the second plate and has a free end and a second contact. This second contact is mounted on the free end opposite the first contact. The switch also has a push button slidably mounted in the housing and having a lateral isolating tab. Also included is a spring means mounted in the housing for outwardly urging the push button and causing the tab to keep apart the first and second contacts. The switch also has a push rod slidably mounted in the housing transverse to the length of the bimetallic blade and aligned with its free end. Thus, depression of the push rod flexes the blade and separates the first and second contacts to allow insertion between them of the tab.

By employing such apparatus, a relatively simple and efficient circuit breaker switch is achieved. In a preferred embodiment, a spring loaded push button is mounted at the front of a housing for making a circuit. A push rod is slidably mounted on the side of the housing to break that circuit. In the preferred embodiment, connection is made into the circuit breaker through a pair of parallel plates, one having a contact, the other supporting in a cantilevered fashion a bimetallic blade, also having a contact. The bimetallic blade is transverse to the plates. A push rod is mounted on the side of the housing and extends to a position adjacent to the bimetallic blade. By depressing the push rod, it can flex the bimetallic blade and separate the contacts.

In this preferred embodiment, the push button has a lateral tab that is adjacent to the contacts. If the contacts separate, either because of the thermal flexing of the bimetallic blade or because of mechanical separation caused by the push rod, the lateral tab springs into position between the contacts and holds them apart. The circuit breaker can be reset by pressing the push button to brings the lateral tab away from the contacts, which then close and hold the lateral tabs in a loaded position.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF THE PREFERRED EMBODIMENTS

Figure 1:
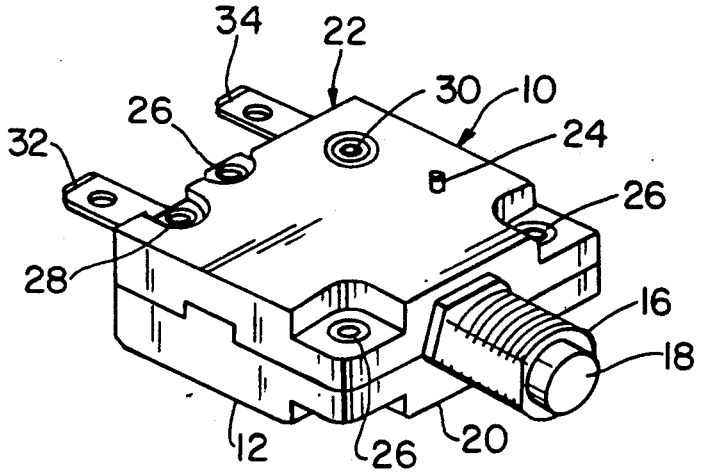
FIG. 1 is a perspective view of an assembled circuit breaker switch in accordance with the principles of the present invention.

Referring to FIG. 1, a housing 10 is shown comprising cover 12 and base 14. The housing has a front 20, a back 22 (not visible in this view) and four sides. Housing 10 is a clam shell design, which clamps over threaded collar 16. Collar 16 holds an axially slidable push button 18. Cover 12 and base 14 of cover 10 are held together by rivets 26 at recesses at both front corners and at the rear edge of housing 10. Rivets 28 and 30 serve a purpose to be described presently.

Push rod 24, described further hereinafter, is mounted in a reset hole in one of the sides. Steel prongs 32 and 34 are first and second electrically conductive plates, also described further hereinafter.

Figure 2:
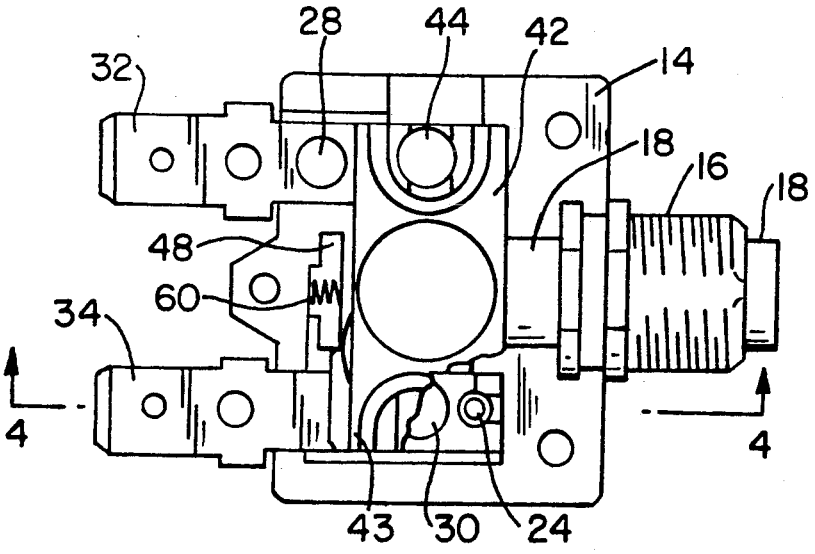
FIG. 2 is a side view of the switch of FIG. 1 with the housing cover removed.
Figure 3:
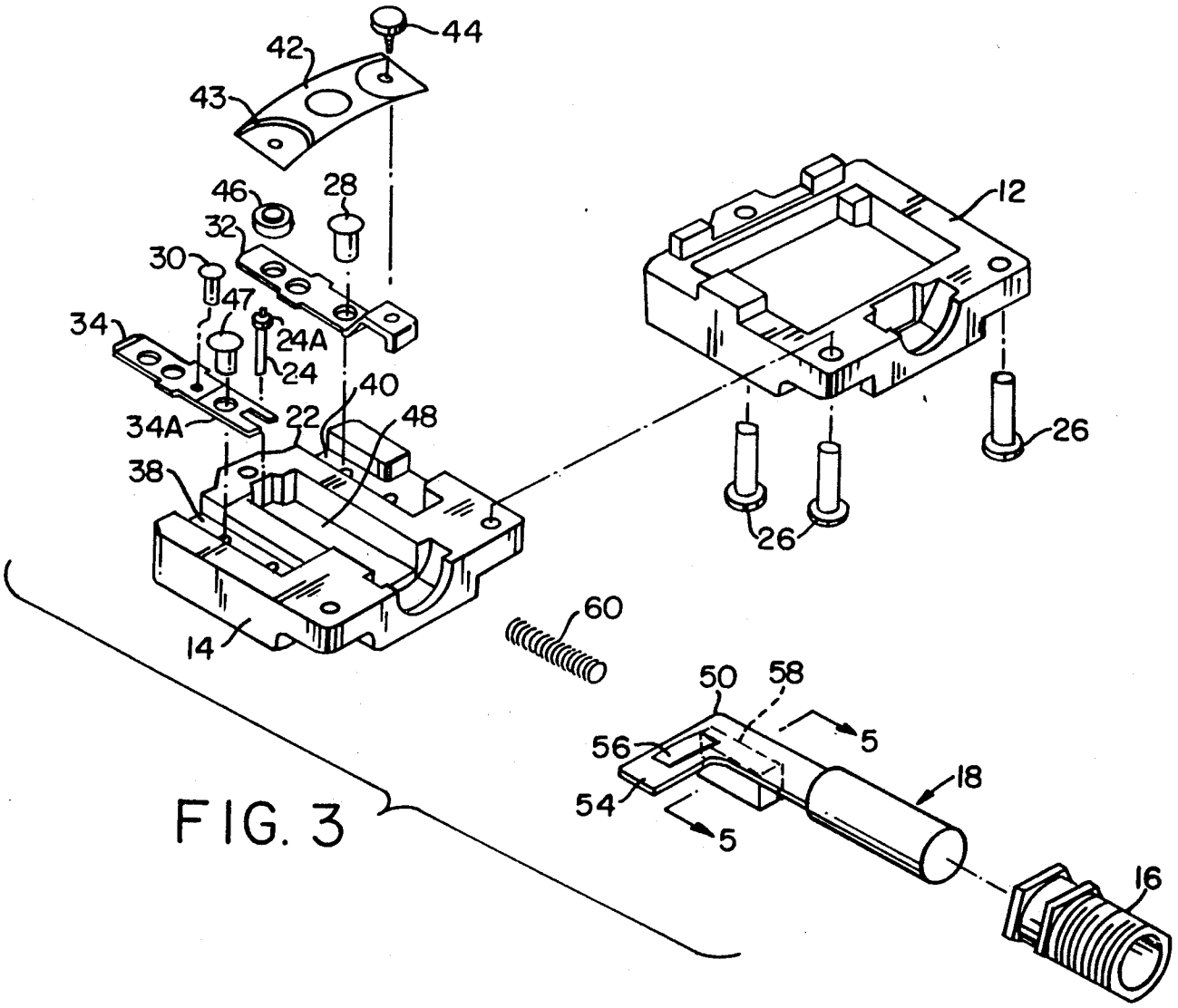
FIG. 3 is an exploded view of the switch of FIG. 1.
Figure 4:
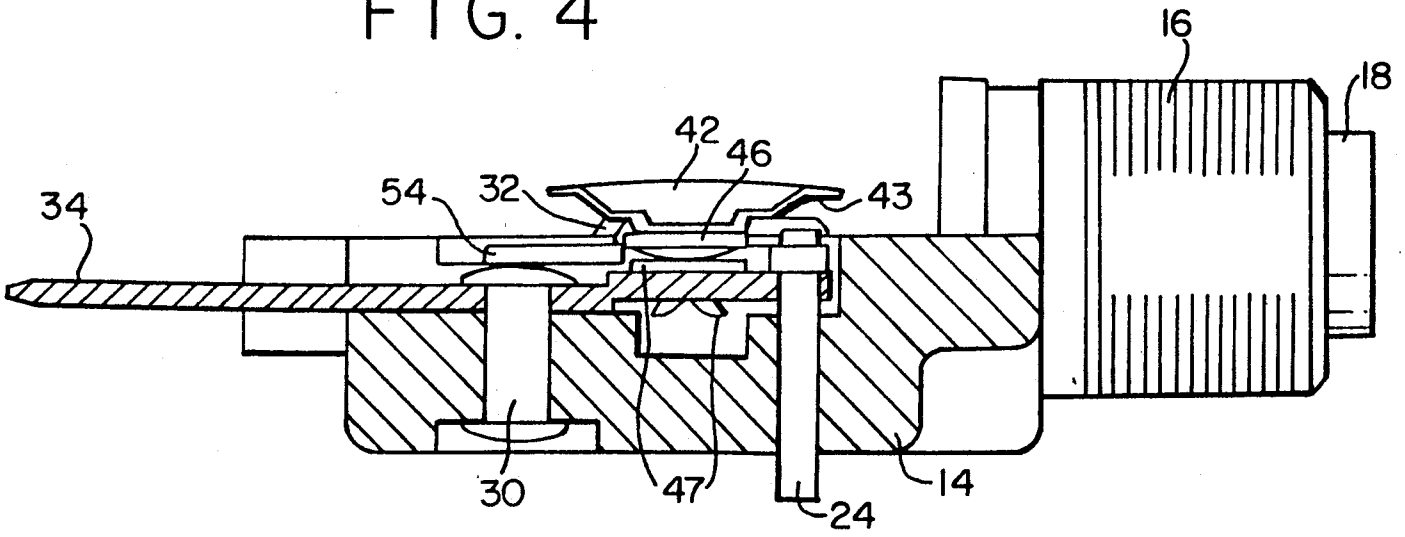
FIG. 4 is a sectional view taken along line 4—4 of FIG. 2.

Referring to FIGS. 2, 3 and 4, the circuit breaker switch is shown in further detail. Base 14 has an elongate concavity 38 and 40 sized to fit first plate 34 and second plate 32, respectively. Plates 32 and 34 are riveted in place by rivets 28 and 30, respectively. Plate 34 has riveted near its inside end first contact 47. Plate 32 has a question mark shape providing an upper platform onto which bimetallic blade 42 is attached by rivet 44. Blade 42 has a domed midsection, which provides a snap action in response to temperature changes, in a known manner. The ends of blade 42 are stamped with depressions for mounting the blade 42 to plate 32 and for riveting a second contact 46 to the free end 43 of blade 42. Free end 43 includes a border, that is, bimetallic material exists to the side of second contact 46.

Push rod 24 is illustrated as a slender cylinder with an enlarged end 24A, in the form of an annular ridge. Rod 24 is embraced by the forked end 34A of plate 34. The forked end 34A provides additional support and guidance for rod 24.

Figure 5:
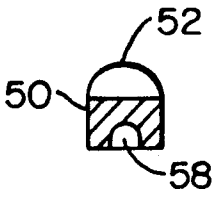
FIG. 5 is a sectional view taken along line 5—5 of FIG. 3.

The outer section 52 of push button 18 is cylindrical. Inner section 50 of push button 18 is held in central concavity 48 in base 14. Integral joined with inner section 50 is a lateral isolating tab 54, which joint is reinforced with supporting rib 56. Inner section 50 has a concavity 58, which as shown in FIG. 5 has a U-shape. A spring means, shown herein as compression spring 60, is mounted between the back 22 of housing 12, 14 and the forward end of concavity 58.

To facilitate an understanding of the principles associated with the foregoing apparatus, its operation will be briefly described. FIG. 4 shows the contacts 46 and 47 touching with the circuit breaker in a set condition (circuit made). Under these circumstances, current can flow through plate 32 bimetallic blade 42, across contacts 46 and 47 and through plate 34. If excessive current flows through bimetallic blade 42, its temperature increases. In a well known manner, the layers of bimetallic blade 42 expand at different rates causing blade 42 to bend. Because the center of blade 42 is domed, it deflects suddenly to provide a snap action. Therefore, when a threshold temperature is reached, blade 42 snaps, abruptly pulling contact 46 away from contact 47.

When this happens, isolating tab 54 has room to move into the just created space between contacts 46 and 47. This motion is produced by compression spring 60 pushing the button 18 and its tab 54. With push button 18 tripped in this fashion, tab 54 remains between contacts 46 and 47 with no further effect.

After bimetallic blade 42 cools sufficiently, push button 18 can be depressed causing tab 54 to slide back to the set position illustrated in FIG. 4. Thereafter, contacts 46 and 47 come together since bimetallic blade 42 is biased towards the closed position, when operating below its threshold temperature.

When the circuit breaker is set, it can also be tripped by depressing push rod 24. Rod 24 is thrust inwardly to engage the underside of the border 43 of bimetallic blade 42. This lifts contact 46 and separates it from contact 47. Again, the space between contacts 46 and 47 allows tab 54 to slide between them as button 18 extends outwardly.

Because rod 24 acts transversely to blade 42, the resulting forces and friction are not excessive. The orientation of rod 24 allows it to produce a direct force in the same direction as the direction of motion needed to separate contacts 46 and 47. Accordingly, push rod 24 can be operated without excessive force and wear is minimized. In addition, the structure is simplified and there is no additional friction from unnecessary moving parts, levers, etc.

It is to be appreciated that various modifications may be impalement with respect to the above described preferred embodiments. For, example, the bimetallic blade can have various sizes and may not be domed in some embodiments. Additionally, the conductive plates may be shaped differently and may have various bends to accommodate the connector to which it may be attached. Instead of rivets, one may use screws or other fasteners. The housing can have multiple concavities or one large open region, depending upon the design criteria. Moreover, the push button can have various shapes and may use other springs including tension springs. The shape of the push rod can be altered and it need not be a straight cylindrical rod. Also, the amount of play can be altered. Furthermore, in some embodiments the rod will not be supported by a forked plate and may be biased by an appropriate spring element. Additionally, the thicknesses, power rating, temperature stability and sensitivity of the various components can altered, depending upon the size, rating and expected operating environment of the circuit breaker.

Obviously many modifications and variations of the present invention are possible in light of the above teachings. It is therefore to be understood that within the scope of the appended claims, the invention may be practiced otherwise than as specifically described.

I claim:

1. A thermally and manually operable circuit breaker switch, comprising:

a housing;

first and second conductive plates mounted in said housing, said first plate having a first contact;

a cantilevered bimetallic blade mounted on said second plate and having a free end and a second contact, said second contact being mounted on said free end opposite said first contact to move with respect thereto in a predetermined direction;

a push button slidably mounted in said housing and having a lateral isolating tab;

spring means mounted in said housing for outwardly urging said push button and causing said tab to keep apart said first and second contacts; and a push rod slidably mounted in said housing to move with a component of motion transverse to the length of said bimetallic blade and parallel to said predetermined direction, so that depression of said push rod flexes said blade and separates said first and second contacts to allow said tab to keep the contacts apart.

2. A circuit breaker switch according to claim 1 wherein said push rod is mounted transversely to said push button.

3. A circuit breaker switch according to claim 2 wherein said housing has a front, a back and four sides, said push button being slidably mounted through the front of said housing, an apertured one of the sides of said housing having a reset hole, said push rod being slidably mounted through said reset hole.

4. A circuit breaker switch according to claim 3 wherein said push rod has an enlarged inner end sized to prevent its escape through said reset hole.

5. A circuit breaker switch according to claim 4 wherein the length of said first plate is transverse to said push rod and said bimetallic blade, said first plate having a forked inner end aligned to embrace said push rod outwardly from its enlarged inner end.

6. A circuit breaker switch according to claim 5 wherein said free end of said bimetallic blade is sized to have a border extending laterally beyond said second contact, said inner end of said push rod being aligned to engage said border alongside said second contact.

7. A circuit breaker switch according to claim 6 wherein said push button comprises:

an outer and inner section, said inner section supporting said lateral isolating tab, said tab being positioned to be inserted between said first and second contacts, said inner section being held between said bimetallic blade and the apertured one of the sides of said housing.

8. A circuit breaker switch according to claim 7 wherein said inner section has a concavity with a U shaped cross section opening radially outwardly from the axis of said push button, said spring means comprising a compression spring held in said concavity and bearing against said push button and the back of said housing.

9. A circuit breaker switch according to claim 8 wherein said push button has a reinforcing rib at the joint between said tab and said inner section.

10. A thermally and manually operable circuit breaker switch, comprising:

a housing having a front, a back and four sides, an apertured one of the sides of said housing having a reset hole;

first and second conductive plates mounted in said housing, said first plate having a first contact;

a cantilevered bimetallic blade mounted on said second plate and having a free end and a second contact, said second contact being affixed to said free end opposite said first contact, said free end of said bimetallic blade being sized to have a border extending laterally beyond said second contact;

a push button slidably mounted through the front of said housing, said push button having a lateral isolating tab and an outer and inner section, said inner section supporting said lateral isolating tab, said push button having a reinforcing rib at the joint between said tab and said inner section, said inner section of said push button being held between said bimetallic blade and the apertured one of the sides of said housing, said inner section having a concavity with a U shaped cross section opening radially outwardly from the axis of said push button;

a compression spring held in said concavity and bearing against said push button and the back of said housing for outwardly urging said push button and for inserting said tab between said first and second contacts; and a push rod slidably mounted through said reset hole in said housing transverse to the length of said bimetallic blade and to the length of said push button, said push rod having an enlarged inner end sized to prevent its escape through said reset hole, the length of said first plate being transverse to said push rod and said bimetallic blade, said first plate having a forked inner end aligned to embrace said push rod outwardly from its enlarged inner end, said push rod being aligned with the free end of said bimetallic blade to engage its border alongside said second contact, so that depression of said push rod flexes said blade and separates said first and second contacts to allow insertion between them of said tab.

* * * * *